US005249714A

United States Patent [19]

Merhar

[11] Patent Number: 5,249,714

[45] Date of Patent: Oct. 5, 1993

[54] POUR SPOUT WITH IMPROVED VALVE STRUCTURE

[76] Inventor: Richard D. Merhar, 551 Morewood Pkwy., Rocky River, Ohio 44116

[21] Appl. No.: 955,463

[22] Filed: Oct. 2, 1992

[51] Int. Cl.[5] ..... B65D 5/72

[52] U.S. Cl. ..... 222/500; 222/541; 222/568; 137/38

[58] Field of Search ..... 222/500, 544, 568, 529, 222/541; 137/38, 43

[56] References Cited

U.S. PATENT DOCUMENTS

| | | | |
|---|---|---|---|
| 788,118 | 4/1905 | Perotti | 137/38 |
| 1,549,858 | 8/1925 | Evans | 222/568 |
| 1,862,193 | 6/1932 | Miller | 222/568 X |
| 1,983,101 | 12/1934 | Scribner | 222/568 X |
| 3,152,712 | 10/1964 | Reiss | 222/500 |
| 4,269,213 | 5/1981 | Sasaki | 137/38 |
| 4,583,668 | 4/1986 | Maynard, Jr. | 222/529 |

*Primary Examiner*—Gregory L. Huson

[57] ABSTRACT

A spout that fits all quart containers is characterized by a twist of the wrist to start and stop oil flow. The spout consists of a tubular cylinder into which an angled ball valve seat and a bubble run-off area has been incorporated. A steel ball moving on and off its valve seat due to the angle of the valve seat and gravity stops and starts the oil flow. When the bubble run-off area is pointed down, causing the steel ball to lodge itself in the bubble run-off area, the oil flows and with a twist of the wrist, making a 180 degree rotation of the spout, the bubble run-off area points up causing the steel ball to seat itself on the valve seat and the oil flow stops. The spout is excellent for hard to reach places and eliminates oil spills. Two tip sizes are incorporated in the spout for small and large filler openings. The small tip is for lawnmower and motorcycles for example and the larger for cars for example. The larger opening is obtained by cutting with a knife or razor or other cutting instrument the spout in a molded recessed area inward of the smaller tip.

4 Claims, 3 Drawing Sheets

POUR SPOUT WITH IMPROVED VALVE STRUCTURE

FIELD OF THE INVENTION

The invention relates to spouts for pouring oil from a quart container into a filler opening.

BACKGROUND OF THE INVENTION

When one pours oil into a filler opening, one often needs to use a funnel or a spout to avoid spillage. A funnel may not be satisfactory for hard to reach areas and it is messy and drips. A spout extends the oil container opening and makes filler openings that are difficult to access more accessible. To avoid oil spillage when placing the spout in and out of a filler opening some sort of shut-off valve is needed to be incorporated into the spout.

BACKGROUND—DISCUSSION OF PRIOR ART

The prior art shown in FIGS. 9–10 is erratic in operation, at best, because the oil pour spout is operational only when at an angle of approximately 15 degrees with the horizontal which is almost totally worthless for the purpose for which the oil pour spout is intended and that is to be able to pour oil with a twist of the wrist in tight and awkward to reach filler openings. Hencefore, the oil pour spout had a horizontal ball valve seat 40 which prevented the steel ball 36 from dropping into the bubble run-off area 24 unless the spout was at an angle of approximately 15 degrees with the horizontal.

OBJECT OF THE INVENTION

The prime goal of the present invention is to provide a spout which will facillitate the pouring of oil from a quart oil container to a filler opening.

An important object of the invention is that the spout of the invention will be easy to use, eliminate oil drips and spills and be a one-handed operation.

Another important object of the invention is that two tip sizes are incorporated in the spout to accommodate small and large filler openings.

Another important object of the invention is that the spout of the invention will be durable and long-lasting yet of economical make.

SUMMARY OF THE INVENTION

In accordance with the objects of the invention there is disclosed an oil pour spout to pour oil from and through the outlet of a quart oil container toward and into an inlet. The oil pour spout consisting of a main elongated tubular section, a threaded connector member fixed at an inlet end of said tubular section and a threaded outlet tip at the other end of said main section. Incorporated in the elongated tubular section is an angled ball valve seat which makes an angle $\theta$ with the horizontal and is adjacent to a bubble run-off area with a steel ball of such diameter as to be able to freely move due to gravity between the angled ball valve seat and the bubble run-off area with the said steel ball stopping the flow of oil when on the said angled ball valve seat and allowing oil to pass through the said oil pour spout when the said steel ball is in the said bubble run-off area.

The surface formed by the last thread of the internally threaded inlet of the said oil spout and difference in diameter of the internally threaded inlet and the elongated tubular section of the said oil spout form a sealing area which forms a seal when the said oil pour spout is used on an oil container. In order for the seal to be leak-proof, both the external threads on the oil container outlet and the inner threads on the internally threaded inlet of the said oil pour spout must be of the same number and pitch and also be perfectly molded in manufacture. An o-ring located above the last molded thread of the inlet of the said oil spout assures a leak-proof seal with the end of the neck finish of the said oil container.

Oil filler openings vary in size which urges the use of different size outlet tips on an oil pour spout, and this would normally urge the manufacture of the oil spouts in different tip sizes, one for larger filler openings and another for smaller filler openings. However, with the invention the larger opening is obtained by cutting with a knife or razor or other cutting instrument the spout in a molded recessed area inward of the smaller tip.

The oil pour spout is first securely twisted on to a quart oil container, the o-ring in the base of the threaded area of the inlet assures a leak-proof seal. The oil container is then inverted making sure that the bubble points up. In this position the steel ball seats itself on its angled ball valve seat in the tubular section cylinder stopping the flow of oil through the oil pour spout which gives ample time to insert the outlet tip into a filler opening. With a twist of the wrist making a 180 degree rotation of the said oil spout and the said oil container, causing the bubble run-off area to point down, and then due to gravity and the angle of the said angled ball valve seat, the said steel ball will overcome the stickion or surface tension and pressure of the oil and move into the bubble run-off area allowing the oil to move freely through the said oil pour spout. In order to stop the flow of oil, another twist of the wrist making a rotation of 180 degrees, so that the said bubble run-off area points up, causes the said steel ball to again seat itself on the said angled ball valve seat, stopping the flow of oil through the said oil pour spout, and the said oil pour spout can be removed from the filler opening.

If the oil is not completely used in the said oil container, the said oil pour spout can be kept on the said oil container and an original closure from the said oil container used to seal the large outlet, or if the smaller tip size was used, a small tip closure can be screwed on to the smaller tip to prevent any foreign matter from getting into the oil.

Advantageously, the said oil pour spout consisting of said tubular section with an angled ball valve seat and said bubble run-off area, said inlet connector and said outlet tips are integrally molded from a single moldable material, preferably a thermo plastic material, more preferably a high density polyethylene which produces a rigid oil pour spout that is both durable and of economical manufacture.

DESCRIPTION OF THE PREFERRED EMBODIMENTS

Figure 1:
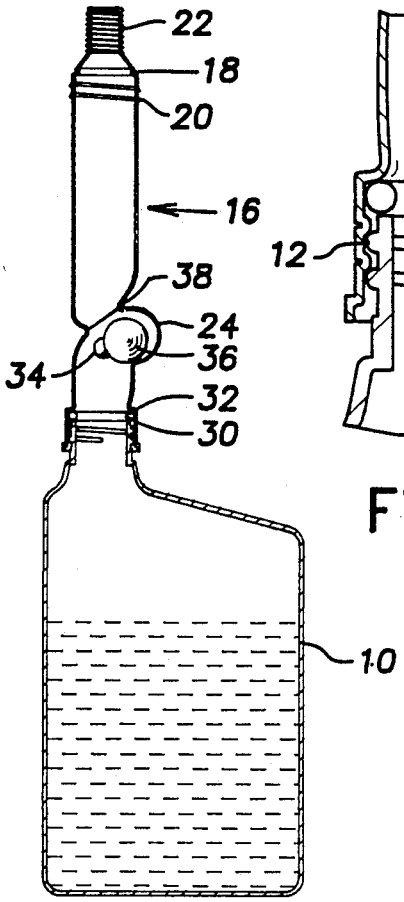
FIG. 1 is a side elevational sectional view of an oil pour spout embodying the invention in assembled relation with a conventional oil container.
Figure 1A:
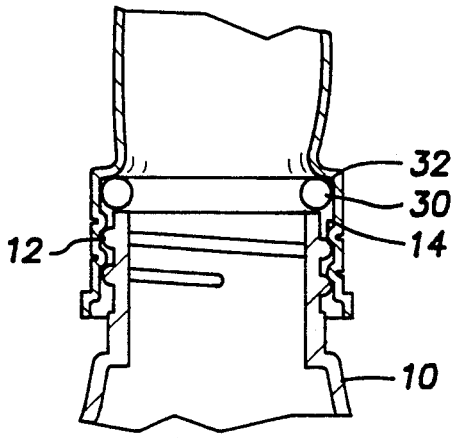
FIG. 1*a* is an enlarged fragmentary view similar to FIG. 1.

In FIGS. 1 and 1*a* an oil spout 16 is securely attached to a quart oil container 10 by screwing the internally threaded inlet 14 of the oil pour spout 16 on to the externally threaded outlet 12 of the quart oil container 10. The o-ring 30 in FIG. 1*a* in the inlet of the oil pour spout 16 assures a leak-proof seal.

Figure 6:
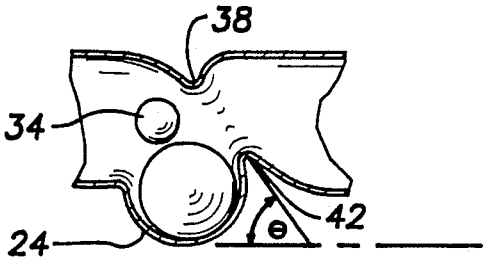
FIG. 6 is a fragmentary view similar to FIG. 4.
Figure 7:
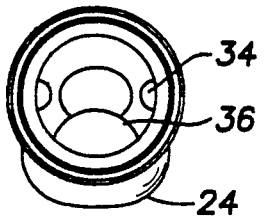
FIG. 7 is the end view of the inlet of the spout taken from the perspective 7—7 of FIG. 4.

Spout member 16 has four important features:

1. It includes the angled ball valve seat 38 in FIG. 4 which lies in the generally flat plane and the plane is at an angle $\theta$ 42 in FIG. 6 which is oblique to the longitudinal axis of the oil pour spout 16, so that the angled ball valve seat 38 is further downstream with increasing distance from the bubble run-off area 24.

Figure 4:
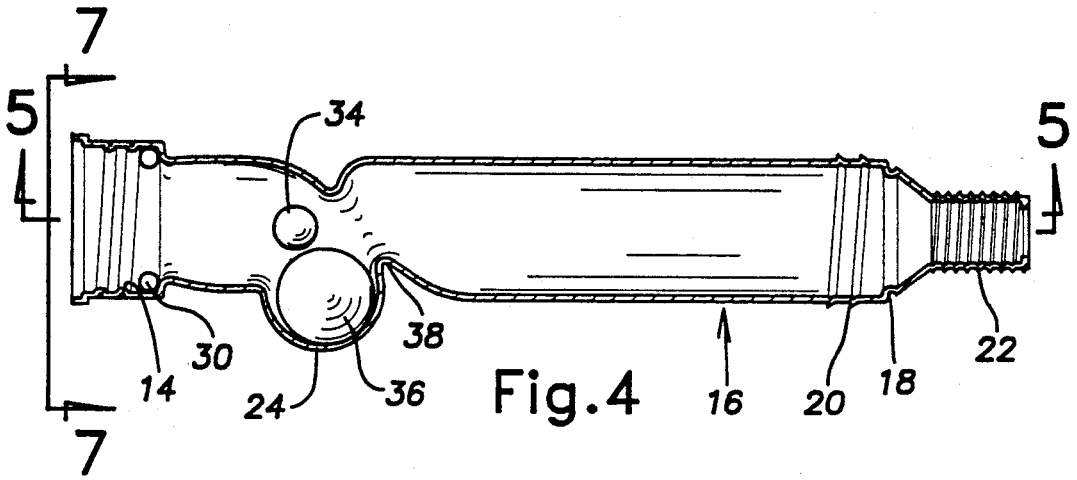
FIG. 4 is a longitudinal sectioned side view showing the interior of the spout.
Figure 5:
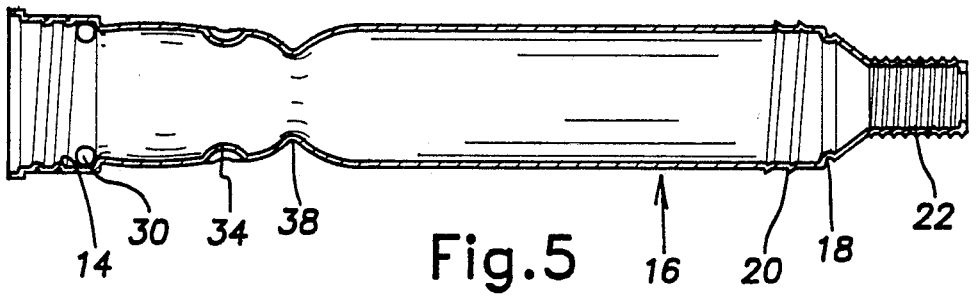
FIG. 5 is a longitudinal sectioned top view taken from the perspective 5—5 of FIG. 4.

2. also the bubble run-off area 24 which is adjacent to the angled ball valve seat 38, 3. and the steel ball 36, by way of example, has a diameter of ¾ inch and a density substantially greater than the plastic material forming the pour spout 16, 4. and finally, the detents 34 as seen in FIGS. 4 and 5 which are proportioned to prevent significent reverse or upstream movement of the steel ball 36.

Figure 2:
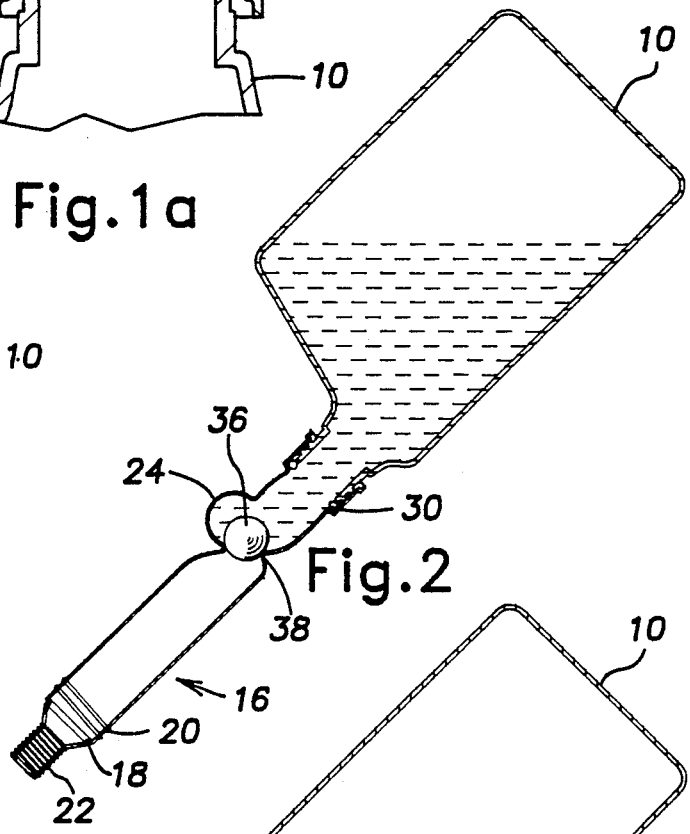
FIG. 2 is a side sectional view of the spout and container in an orientation just prior to pouring.
Figure 3:
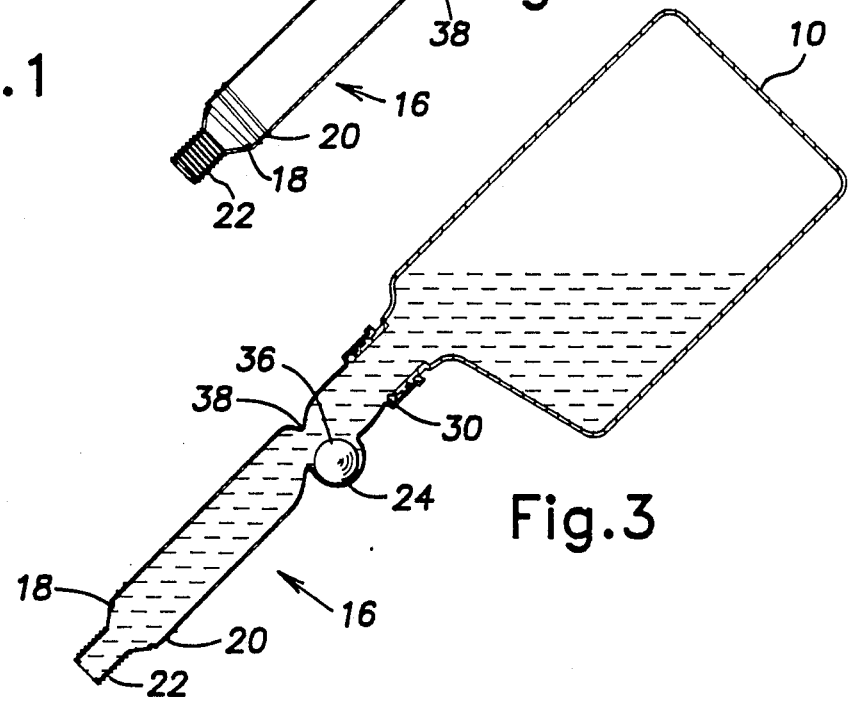
FIG. 3 is a side section view of the spout and container in an orientation permitting pouring of liquid contents.

The oil pour spout 16 securely attached to a quart oil container 10 is then inverted as in FIG. 2 making sure that the bubble run-off area 24 points up. In this position the steel ball 36 seats itself on an angled ball valve seat 38 in the tubular section of the spout 16 stopping the flow of oil through the pour spout 16 as shown in FIG. 2, which gives ample time to insert the outlet tip 20 or 22 into a filler opening. With a twist of the wrist making a 180 degree rotation of the oil spout 16 and the oil container 10, causing the bubble run-off area 24 to point down as in FIG. 3 and then due to gravity and the angle $\theta$ 42 in FIG. 6 of the angled ball valve seat 38, the steel ball 36 will overcome the sticktion and pressure of the oil and move into the bubble run-off area 24 allowing the oil to move freely through the oil pour spout 16.

Figure 8:
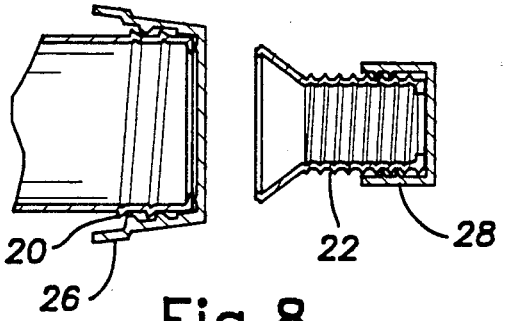
FIG. 8 is a fragmentary side sectional view similar to FIG. 4 of the outlet and of the spout with the small threaded end shown as severed from the large externally threaded portion thereof with closures secured on the externally threaded portions.
Figure 9:
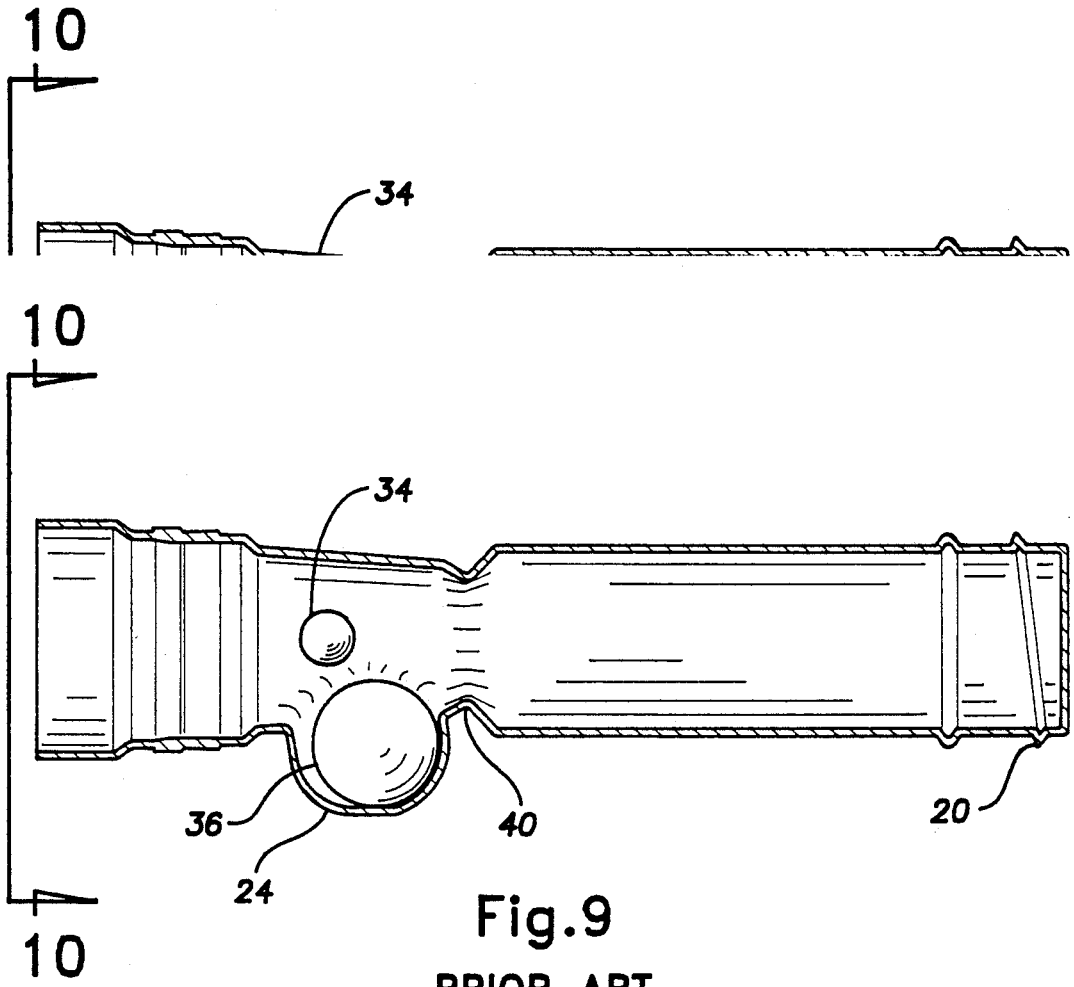
Fig.9 PRIOR ART
FIG. 9 is a sectional view, taken on a longitudinal plane, of a prior art pour spout.
Figure 10:
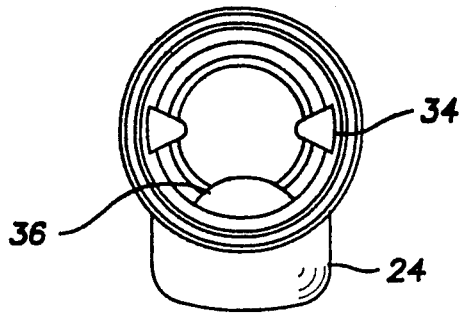
FIG. 10 is an end view of the prior art spout of FIG. 9 taken in the plane indicated at 10—10 in FIG. 9.

If the oil is not completely used in the oil container 10, the pour spout 16 can be kept on the oil container 10 and the original closure 20 in FIG. 8 from the oil container 10 in FIG. 1 can be kept on the oil container 10 used to seal the large outlet 20 of the spout 16 in FIG. 8, or if the smaller tip 22 of the oil spout 16 is used, a small tip closure 28 can be screwed on the smaller tip 22 as in FIG. 8 to prevent any foreign matter from getting into the oil. The external threads of the small tip outlet 22 and the internal threads of the small tip closure 28 are 15 mm×2 mm pitch, while the threeads on the externally threaded large tip 20 and the closure from the oil container 26 have threads 12 mm×1 mm pitch.

FIG. 1 shows that the detents 34 are proportioned to prevent significant reverse or upstream movement of the steel ball 36 so that it is in the interior of the pour spout 16, captured between the angled ball valve seat 38, the bubble run-off area 24 and the detents 34. The steel ball 36 is in a loose fit with the interior walls of the oil spout 16 between its limits of movement determined downstream by the angled ball valve seat 38 and upstream by the detents 34 as in FIG. 1.

Oil filler openings vary in size which urges the use of different size outlet tips 20 and 22 on an oil pour spout 16, and this would normally urge the manufacture of the oil spout 16 in different tip sizes, one for larger filler openings and another for smaller filler openings. The larger tip opening 20 is obtained by cutting with a knife, a razor, or other cutting instrument the molded groove 18 as seen in FIG. 4 which is transverse to the longitudinal axis of the pour spout 16. This molded grove 18 or score line facillitates cutting the small diameter threaded tip 22 from the larger diameter threaded tip 20 as seen in FIG. 8.

The oil pour spout 16 consisting of a tubular section with an angled ball valve seat 38, the bubble run-off area 24, inlet connector 14 and outlet tips 20 and 22 is integrally blow molded from a single moldable material, preferably a thermo plastic material, more preferably a high density polyethylene which provides a rigid oil pour spout 16, that is both durable and of economic manufacture. The length of the oil pour spout 16 with the large outlet tip 20 is approximately 7 inches, while the oil pour spout 16 with the smaller outlet tip 22 is approximately 6 inches. The inside diameter of the pour spout small tip 22 is 0.40 inches while the inside diameter of the larger tip 22 in 1 inch.

The oil pour spout 16 is useful with liquids other than motor oil, such as transmission fluid, brake fluid, and power steering fluid. The spout can be used on container sizes other than one quart.

I claim:

1. A pour spout adapted to dispense oil or other liquid from a container comprising a tubular body having an inlet portion and an outlet portion, the inlet and outlet portions having a generally common longitudinal axis, a valve seat disposed within said body between said inlet and outlet portions, a heavy valve ball in the body adapted to selectively close the valve seat to prevent flow of liquid from the inlet portion to the outlet portion, means in the inlet portion retaining the ball in a zone adjacent the valve seat, a ball run-off area in the inlet portion eccentric to said axis adapted to receive the ball at a location sufficiently displaced from the seat to allow flow of liquid through the body from the inlet portion to the outlet portion, the valve seat lying in a plane forming an oblique angle with respect to said axis, the orientation of the plane of the valve seat being such that the area of the seat adjacent the run-off area is downstream with reference to the direction of flow through the body relative to the area of the seat remote from the run-off area, the body being constructed and arranged in combination with said valve ball such that when the body is disposed with its outlet portion lower than its inlet portion and the ball run-off area in a non-pour position above the axis, the valve ball closes the valve seat and with the ball run-off area in a pour position below the axis, the valve ball is readily received in the ball run-off area to open the valve seat without a significant tendency to stick on the valve seat due to surface tension forces of the liquid being dispensed.

2. A pour spout as set forth in claim 1, wherein the plane of the valve seat is between 15 and 85 degrees from the axis.

3. A pour spout as set forth in claim 1, wherein said inlet portion includes internal threads adapted to be screwed on the threaded mouth of a container and an O-ring positioned in said inlet portion inward of said threads and adapted to seal the end of the container mouth.

4. A pour spout as set forth in claim 1, wherein said outlet portion has a reduced diameter dispensing section at its outlet end and a larger diameter dispensing section upstream of its outlet end, said outlet portion being adapted to be cut with a knife or like instrument to remove said reduced diameter dispensing section and permit dispensing directly from said larger diameter dispensing section.

* * * * *